United States Patent [19]

Kachnik

[11] Patent Number: 4,462,466

[45] Date of Patent: Jul. 31, 1984

[54] METHOD OF PROPPING FRACTURES IN SUBTERRANEAN FORMATIONS

[76] Inventor: Joseph E. Kachnik, Overton Natl. Bank Bldg., 4200 S. Hulen, Ste. 212, Fort Worth, Tex. 76116

[21] Appl. No.: 362,960

[22] Filed: Mar. 29, 1982

[51] Int. Cl.[3] ..... E21B 43/267

[52] U.S. Cl. ..... 166/280

[58] Field of Search ..... 166/280; 428/402

[56] References Cited

U.S. PATENT DOCUMENTS

| | | | |
|---|---|---|---|
| 3,155,162 | 11/1964 | Flickenger et al. | 166/280 |
| 3,266,573 | 8/1966 | Rixe | 166/280 |
| 3,363,690 | 1/1968 | Fischer | 166/280 |
| 3,399,727 | 9/1968 | Graham et al. | 166/280 |
| 4,029,148 | 6/1977 | Emery | 166/280 |
| 4,336,338 | 6/1982 | Downs et al. | 428/402 |

*Primary Examiner*—Stephen J. Novosad
*Assistant Examiner*—William P. Neuder
*Attorney, Agent, or Firm*—Wofford, Fails & Zobal

[57] ABSTRACT

A method of propping fractures in a subterranean formation employing high-strength particles of propping agent having at least one passageway formed through each of the particles and having the usual high compressive strength and particle size range and density to enable emplacement in the fracture by hydraulic transport. Each particle has its at least one passageway formed substantially directly therethrough for increased permeability to flow of fluids from the subterranean formation. Particles may have any of the shapes that are commonly and economically available.

3 Claims, No Drawings

METHOD OF PROPPING FRACTURES IN SUBTERRANEAN FORMATIONS

BACKGROUND OF THE INVENTION

This invention relates to treating a subterranean formation around a wellbore or the like, in which the formation is fractured to increase production. More particularly, the invention relates to methods for propping such fractures open by displacing particles of propping agent into the fracture system.

DESCRIPTION OF THE PRIOR ART

As is well known, fluids such as crude oil and natural gas are produced from porous and permeable subterranean formations. The porosity or void space of the formation is a measure of its ability to store the oil and gas, and its permeability is a measure of the conductivity of the fluids from the formation. Permeability is frequently improved around a wellbore drilled into the subterranean formation by fracturing, acidizing and the like.

Hydraulic fracturing is a commonly employed method for increasing the permeability of a formation. It is a method for artificially creating channels of high fluid conductivity from the wellbore out into the formation. These fractures tend to close if they are not propped open. The propping of the fractures is frequently done by pumping in particles of fracturing agent during or immediately following the hydraulic fracturing technique. The high pressure of the hydraulic fluid being injected causes the formation to split along planes of weakness and these fractures are then propped open by the deposition of the particles of the propping agent.

As indicated, the fractures tend to close once the hydraulic pressure is stopped and various propping agents have been employed. Typical propping agents include generally round sand grains, metallic shot, particles coated with bonding materials; for example, walnut hull fragments coated with furfural alcohol or other bonding additives. In the past, it has been conceded that spherical particles of substantially uniform size were the most effective proppants and tended to hold the fractures open better without being themselves embedded into the formation, and yet retain high structural resistance to collapse and permeability to fluid flow.

The improvement in injectivity or productivity of a well by fracturing the formation thereabout depends directly on the retrained fluid conductivity of a propped fracture system. A wide variety of different techniques and propping agents have been tried in the prior art. The following publications represent a typical cross section turned up by a pre-examination search. The following U.S. patents are illustrative of the prior art.

U.S. Pat. No. 2,879,847 discloses geometrical shapes that can be emplaced in the proppant-fracture system to try to improve permeability. This discloses protrusions on the sides of three dimensional objects such as spheres or the like to increase permeability intermediate the spheres or the other shapes.

U.S. Pat. No. 3,235,007 shows multiple layers of respective proppants teaching, for example, metals, ceramics, plastics, steel shot, aluminum, glass beads and crushed and rounded walnut shells, peach shells, coconut shells, pecan shells.

U.S. Pat. No. 3,266,573 shows a method of fracturing subsurface formations in which proppant and spacers therebetween were employed for increased fluid flow through the interstices between the particles of propping agent.

U.S. Pat. No. 3,417,819 showed glass beads flowed into a fracture system with a high viscosity liquid during fracturing.

U.S. Pat. No. 3,497,008 showed glass or ceramic particles having critical impact abrasion resistance flowed into the fracture system.

U.S. Pat. No. 3,701,383 showed electroless metal plating followed by a proppant displaced into the fracture system.

U.S. Pat. No. 3,780,807 showed injection of a fluid suspension of coarse particles with fine grains of sand or other material bonded to the outer surfaces to maintain pathways between the particles.

U.S. Pat. No. 3,976,138 showed injection of alumina propping agents the size of at least 30 mesh being introduced into a fracture system in a multilayer distribution scheme.

U.S. Pat. No. 4,029,148 shows the color-coding of proppant particles injected at different depths so that the source of the proppant particles can be determined in case they backflow and are trapped later in production.

U.S. Pat. No. 4,157,116 shows the use of material injected to plug a zone around a wellbore in a subterranean formation.

Other publications show the use of carborundum sintered bauxite particles as a proppant. Theoretical discussions are presented in Petroleum Engineering magazine and in standard texts on the subject. Illustrative of such articles is "HOW TO SELECT A PROPPING AGENT FOR HYDRAULIC FRACTURING TREATMENTS"; R. E. Steanson, J. L. Elbel, and C. L. Wendorff; PETROLEUM ENGINEER INTERNATIONAL, July, 1979. These treatices have all been concerned with trying to maintain flow passageways between particles for retaining permeability, yet maintaining particle contact for retaining high structural strength for propping the fracture open. As such, these processes have tended to allow closure over time of production or injection of fluid because of the small movement of the particles with a resultant infusion of particle edges and the like into the passageways to restrict permeability. Moreover, these various particles and methods have been resistant to creating the desirable layering in a fully packed propping system in a fracture; and they have tended to fail in deeper formations where the pressures tending to close a fracture were even greater.

SUMMARY OF THE INVENTION

Accordingly, it is the object of this invention to provide a method of propping fractures that obviates the disadvantages of the prior art and provides a fracture system that resists collapse and closure of the fracture and that retains premeability through a unique mechanism not heretofore employed.

It is a specific object of this invention to provide a method of emplacing a proppant that will hold a fracture open with structural strength, yet employ permeability through particles as well as around the particles, thereby obviating the disadvantages of the prior art approaches.

These and other objects will become apparent from the descriptive matter hereinafter.

In accordance with this invention, there is employed a method of propping a fracture system open in a subterranean formation surrounding a wellbore comprising injecting into the fracture system a plurality of particles of propping agent, such particle having at least one passageway formed directly therethrough for increased permeability to flow of fluids from the subterranean formation. The terminology "directly therethrough" is employed herein to signify that the passageway is substantially straight passageway deliberately formed through the particle of propping agent for increased permeability. The particles are the size and density to be flowed into the fracture system by hydraulic transport and have adequate compressive strength for the particular well depth to resist closure of the fracture of the respective passageways through the particles.

DESCRIPTION OF PREFERRED EMBODIMENTS

Typically, in fracturing a subterranean formation penetrated by a wellbore, a formation packer is located and set into the well on the tubing to isolate and confine a selected producing zone to be fractured. Fracturing fluid is usually a low-penetrating fluid such as a viscous liquid that can entrain and carry the proppant particles as well as have an increased hydraulic pressure for fracturing the formation without injection of unduly large amounts of fluid into the formation. Frequently, suspensions are employed to form a filter cake on the face of the formation. The pressure and flow is increased until the formation breakdown is achieved and the fractures are propagated out into the formation the desired distance. The proppants, or particles of propping agents, are emplaced in the fracture system to maintain the fractures open after hydraulic pressure is stopped.

The particles of propping agent used herein may be of any shape that have been previously described in the prior art. For example, they may be spherical, ellipsoidal, cubical, hexagonal, octagonal, cylindrical, prismatic or any other shape as long as they are amenable to the forming of passageways directly therethrough for increased permeability to flow of fluids through the particles, as well as through the interstices around the particles as the fluid flows from the formation in the case of production. Of course, when the injection of a fluid is desired, the fluid will be flowed into the formation, as in water injection, miscible flooding, and the like. It is relatively immaterial in this invention whether the fluid is flowed into the formation or from the formation, since the particles of propping agent having the passageways formed therethrough allow increased permeability.

The particles may be made from any of the high-strength materials that have satisfactory compressive strength and density to prop the fracture open and resist the closing forces in the fracture system and to allow the particles to be deposited by hydraulic transport. Typically, the particles will be formed of man-made substances such as silicic material like hard glass, soda-lime-silica particles in the unannealed or untempered state, alumina, aluminosilicate, ceramic, porcelain, steatite, and mullite particles.

The passageways may be formed by any of the conventional means and will depend in large measure upon the type of particles being employed. For example, if glass particles are employed, the technique such as described in A HANDBOOK ON BEADS, W. G. N. van Sleen, Chapter III, "The Fabrication and Technique of Glass Beads", Liberty CAP Books, 1973, York, PA 17402 (Ref. 746.55). Therein is disclosed a system for elongated tubular structures of glass having penetrating the passageways and, thereafter, cut into the desired size. On the other hand, the passageways may be formed by drilling with lasers a passageway through the material, or any other such technique. Preferably a mass-production type of technique is employed to ensure an economical formation of the particles with the passageways directly therethrough. In a preferred embodiment, the more nearly spherical particles having the passageways formed therethrough are employed because of their high resistance to crushing; compared to particles such as cylinders that have thinner walls.

Hence, the shapes such as spherical, ellipsoidal, cubical, hexagonal, and octagonal, having the passageways therethrough are preferred particles of propping agent.

The particle sizes of propping agent that are injected may range from very small sizes to relatively large sizes and as nearly uniform as practical for increased permeability following deposition. For example, particle sizes may range from as small as 0.02 inch maximum dimension to as much as about 0.3 inch or more.

Preferably, the particles are beads whose maximum dimensions do not vary more than about three-fold from the smallest to the largest in order to obtain good permeability both around and through the particles.

The particles have a density so great as to tend to remain in place and not be readily flowed from the formation and not to float on the injection fluid, and yet a density not so great as to tend to settle out of the injection fluid too rapidly. A specific gravity in the range of 1.5–5 will suffice. Ordinarily, the density range of the material will be such that its specific gravity will lie in the range of 2–4. In practicing the invention, the particles are usually added to the fracturing fluid in a concentration of about 0.2 pounds per gallon of fluid up to as much as about 8–10 pounds or more per gallon of fluid when a fully packed fracture is desired. Partial layers of proppant may be employed with lower concentrations of the particles in the fracturing fluid.

As indicated hereinbefore, the fracturing fluid will have a critical viscosity, for example, it will ordinarily be at least 100 centipoises and, preferably, greater than 300 centipoises; but no more than 10,000 centipoises, to displace the fracture into the formation and to lay down the proppant particles in the fracture system.

One serendipitous benefit of this invention is that the more nearly spherical particles can be employed in the fracturing fluid and can, because of the formed passageway, resist the usual tendency of spherical particles to settle out too rapidly.

With the particles of propping agent of this invention, sustained permeability for protracted intervals has been found to exist in the fracture systems into which these particles having the passageways therethrough have been injected. Moreover, the injected particles have resisted the closure of the fractures as effectively as the conventional prior art particles.

From the foregoing, it can be seen that this invention achieves the objectives delineated hereinbefore as desirable though not heretofore achieved. Specifically, this invention provides a method and propping agents for propping fractures in which the fractures remain propped open to resist closure by the high structural strength of the particles of propping agent but also retain increased permeability because of the passageways through the particles that allow fluid to flow therethrough directly without tortuous passageways, and in addition to the usual flow channels around the particles of propping agent.

Having thus described the invention, it will thus be understood that such description has been given by way of illustration and example and not by way of limitations, reference for the latter purpose being had to the appended claims.

What is claimed is:

1. A method of propping a fracture in a subterranean formation surrounding a wellbore comprising injecting into the fracture a plurality of particles of propping agent, each particle having at least one passageway formed directly therethrough for increased permeability to flow of fluids from the subterranean formation once flow of fluids is restored; said particles being of a size and density to be flowed into the fracture by hydraulic transport and having adequate compressive strength to resist closure of said fracture and respective said passageway through said particles.

2. The method of claim 1 wherein said particles comprise beads having maximum dimensions and range of 0.02–0.3 inch, and a modulus of compression within a range of 6,000–15,000 pounds per square inch and a specific gravity within a range of 1.5–5.

3. The method of claim 2 wherein said beads are graded into respective sub-ranges of sizes; the beads within each sub-range being colored a respective color to facilitate injection of desired sizes of beads for sequencing and the like.

* * * * *